US009079397B1

(12) United States Patent
Carlson et al.

(10) Patent No.: US 9,079,397 B1
(45) Date of Patent: Jul. 14, 2015

(54) INKJET PRINTER HAVING SWITCHED FIRING OF ADJACENT NOZZLES APPLYING COMMON COLOR

(71) Applicant: Marvell World Trade Ltd., St. Michael (BB)

(72) Inventors: Gregory F. Carlson, Corvallis, OR (US); Steven Goss, Corvallis, OR (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

(21) Appl. No.: 14/325,035

(22) Filed: Jul. 7, 2014

Related U.S. Application Data

(63) Continuation of application No. 12/098,812, filed on Apr. 7, 2008, now Pat. No. 8,770,718.

(60) Provisional application No. 60/910,342, filed on Apr. 5, 2007.

(51) Int. Cl.

| | |
|---|---|
| ***B41J 2/15*** | (2006.01) |
| ***B41J 2/07*** | (2006.01) |
| ***B41J 2/21*** | (2006.01) |

(52) U.S. Cl.
CPC . *B41J 2/07* (2013.01); *B41J 2/2132* (2013.01)

(58) Field of Classification Search
CPC ..... B41J 2/07; B41J 2/2132
USPC ..... 347/41
See application file for complete search history.

(56) References Cited

U.S. PATENT DOCUMENTS

| | | | |
|---|---|---|---|
| 4,728,968 | A | 3/1988 | Hillmann et al. |
| 4,748,453 | A | 5/1988 | Lin et al. |
| 5,661,510 | A | 8/1997 | Brandon et al. |
| 5,692,108 | A | 11/1997 | Donahue |
| 6,024,440 | A | 2/2000 | Murthy et al. |
| 6,398,332 | B1 | 6/2002 | Silverbrook et al. |
| 6,755,504 | B2 | 6/2004 | Tee et al. |
| 2006/0139380 | A1 | 6/2006 | Walmsley et al. |

OTHER PUBLICATIONS

International Search Report mailed Jul. 28, 2008, for International Application No. PCT/US2008/059560 (2 pages).
Written Opinion of the International Searching Authority mailed on Jul. 28, 2008, for International Application No. PCT/US2008/059560 (6 pages).

*Primary Examiner* — Julian Huffman

(57) ABSTRACT

A printing system includes a printhead having adjacent inkjet nozzles for dispensing a common colored ink and a controller adapted to direct firing of the adjacent inkjet nozzles so that adjacent local areas using the common colored ink are printed on a printing medium with alternate firings of the adjacent inkjet nozzles.

20 Claims, 9 Drawing Sheets

INKJET PRINTER HAVING SWITCHED FIRING OF ADJACENT NOZZLES APPLYING COMMON COLOR

CROSS-REFERENCE TO RELATED APPLICATION

This application is a continuation of U.S. application Ser. No. 12/098,812 which claims the benefit of U.S. Provisional Application No. 60/910,342, filed Apr. 5, 2007, the content of both of which are hereby incorporated by reference in their entirety.

BACKGROUND

Inkjet printers find uses in a wide range of applications. Reductions in ink drop application sizes have made inkjet printers useful in color printing, such as the printing of photographs.

When rows or columns of nozzles are used to eject drops to form an image, small horizontal and/or vertical bands may be created by a plugged or malfunctioning nozzle. Horizontal and/or vertical bands also may be caused by directionality errors in ejected drops. Depending on manufacturing variations in the printhead, ejected drops may not always be ejected exactly perpendicular to the print medium. The bands created by such plugged nozzles, malfunctioning nozzles, and/or ejection directionality may be detected by the human eye thereby diminishing the quality of the printed image.

There are methods that may be used to detect nozzles that are not working properly. Such methods may be fairly expensive to implement in a consumer product. If a non-functioning nozzle is detected, compensation may be made by passing another working nozzle over the portion of the image associated with the non-functioning nozzle. However, high-speed printing may be done with only one or two passes of the nozzles over the same location on an image that is the printed. This makes it difficult to compensate for non-functioning nozzles. This is especially difficult for page wide array printheads. Since the printhead of a page wide array does not move, there may be no opportunity to use another nozzle to compensate for the plugged or malfunctioning nozzle.

SUMMARY

The present invention is defined by the following claims, and nothing in this section should be taken as a limitation on those claims.

By way of introduction, the preferred embodiments described below provide a printing system including a printhead having adjacent inkjet nozzles for dispensing a common colored ink and a controller adapted to direct firing of the adjacent inkjet nozzles so that adjacent local areas using the common colored ink are printed with alternate firings of the adjacent inkjet nozzles. In one preferred embodiment, the printing system includes a page width printhead. In another preferred embodiment, the printing system includes a printhead that moves along a carriage. In another preferred embodiment, the adjacent inkjet nozzles are arranged in logical pairs. In a still further preferred embodiment, the adjacent inkjet nozzles are arranged in configurations of three or four nozzles. Other preferred embodiments are provided, and each of the preferred embodiments described herein can be used alone or in combination with one another.

The preferred embodiments will now be described with reference to the attached drawings.

DETAILED DESCRIPTION OF THE PRESENTLY PREFERRED EMBODIMENTS

Figure 1:
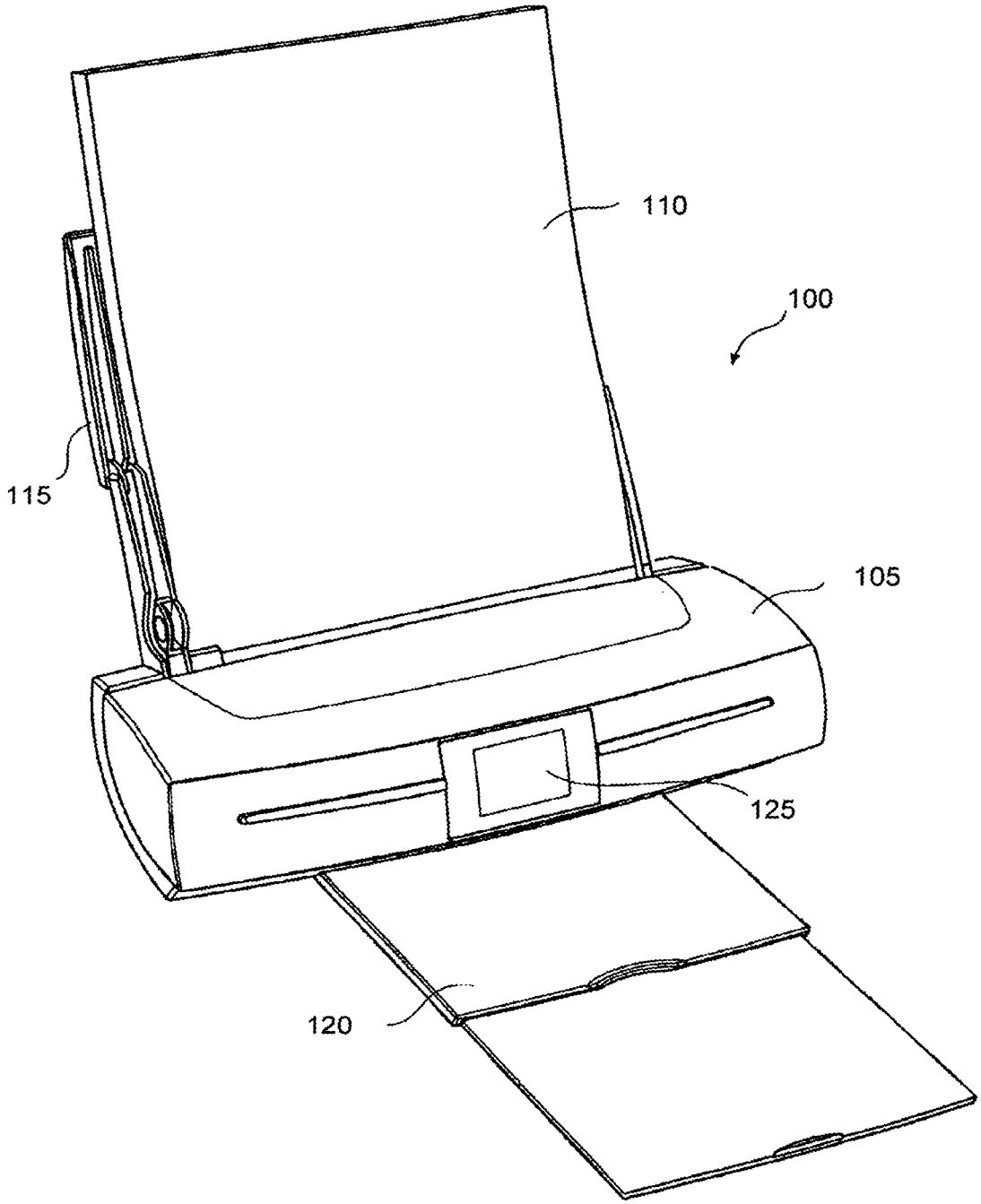
FIG. 1 shows an exemplary inkjet printer 100.

FIG. 1 shows an exemplary inkjet printer 100 that reduces artifacts, such as banding, that may occur as a result of a malfunctioning nozzle. Switched firings of adjacent inkjet nozzles that eject the same color reduces the perceived effects of failure of one of the adjacent inkjet nozzles.

The inkjet printer 100 includes a main printing section 105 through which a printing medium 110, such as paper, passes for printing. A printing medium input support 115 is disposed to support the printing medium 110 as it is provided to the input of the main printing section 105. A printing medium output support 120 is disposed at the output of the main printing section 105 to receive the printing medium 110 after printing. A user interface 125 may be provided in the main printing section 105 to allow an operator to access various functions associated with the printer 100. The user interface 125 may include buttons, a display, a touchscreen, or other human interface components.

Figure 2:
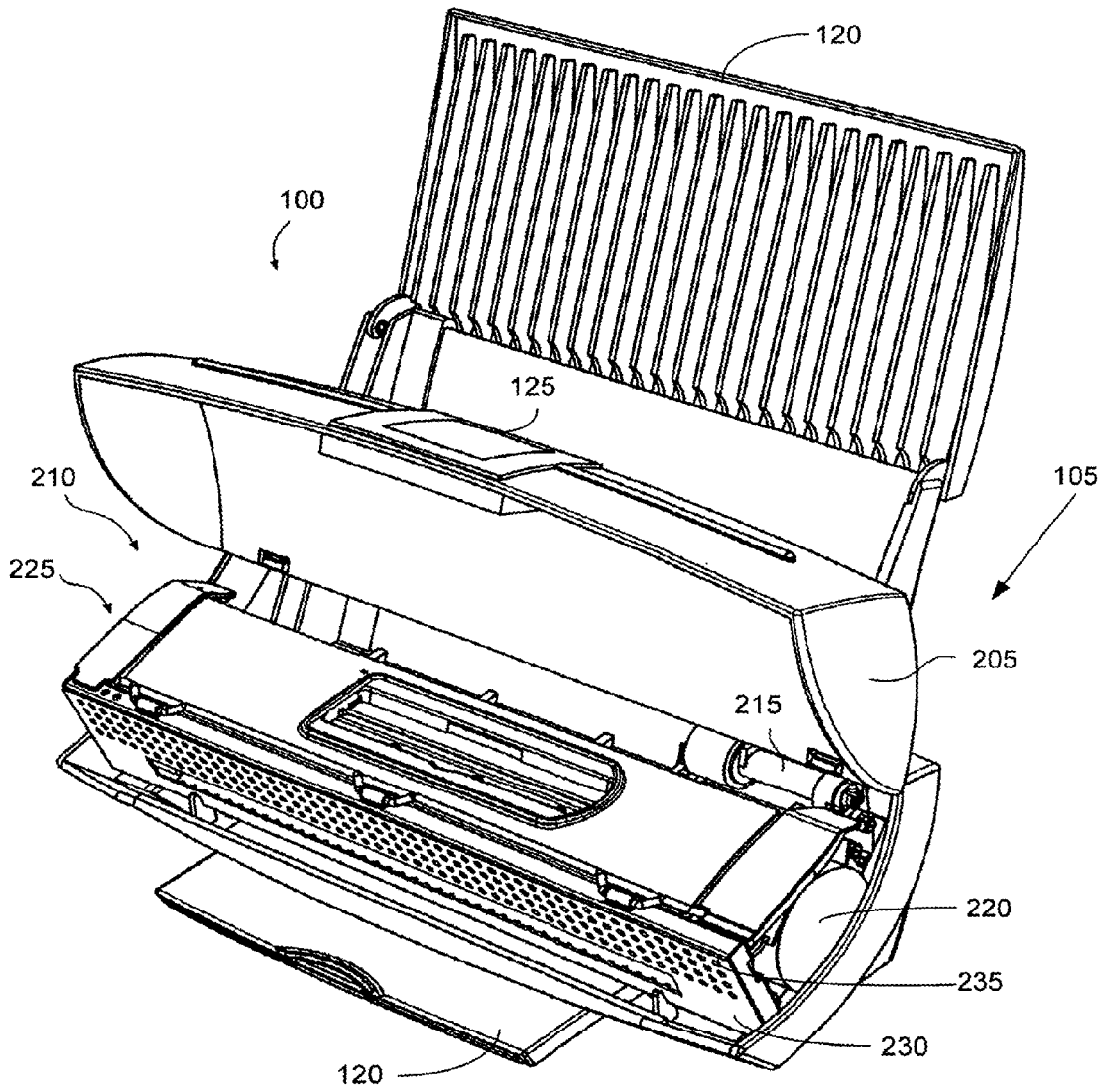
FIG. 2 is a perspective view of the inkjet printer of FIG. 1 with its cover in the upright position to expose some of its components.

FIG. 2 is a perspective view of the inkjet printer 100 with its cover 205 in the upright position to expose some of its components 210. Components 210 may include a pinch roller assembly 215 that is driven by a corresponding motor 220. The pinch roller assembly 215 and motor 220 cooperate with one another to direct printing media 110 through the main printing section 105. Components 210 also may include a printer cartridge 225 including a printhead assembly 230. In FIG. 2, the printer cartridge 225 and printhead assembly 230 are arranged for page wide printing on the printing media 110.

The printhead assembly 230 may include a plurality of inkjet nozzles 235 disposed to eject miniscule droplets of ink on the printing media 110. The inkjet nozzles 235 may be arranged in a plurality of horizontal rows, where each row ejects the same color ink. For example, a first row may eject red ink, a second row may eject green ink, a third row may eject blue ink, and a fourth row may eject black ink. Alternatively, for example, the first row may eject cyan ink, the second row may eject magenta ink, the third role may eject yellow ink, and the fourth row may eject black ink. Additional rows of nozzles may be added to the printhead assembly 230 to implement a six color printing system that provides orange and green ink as well.

Figure 3:
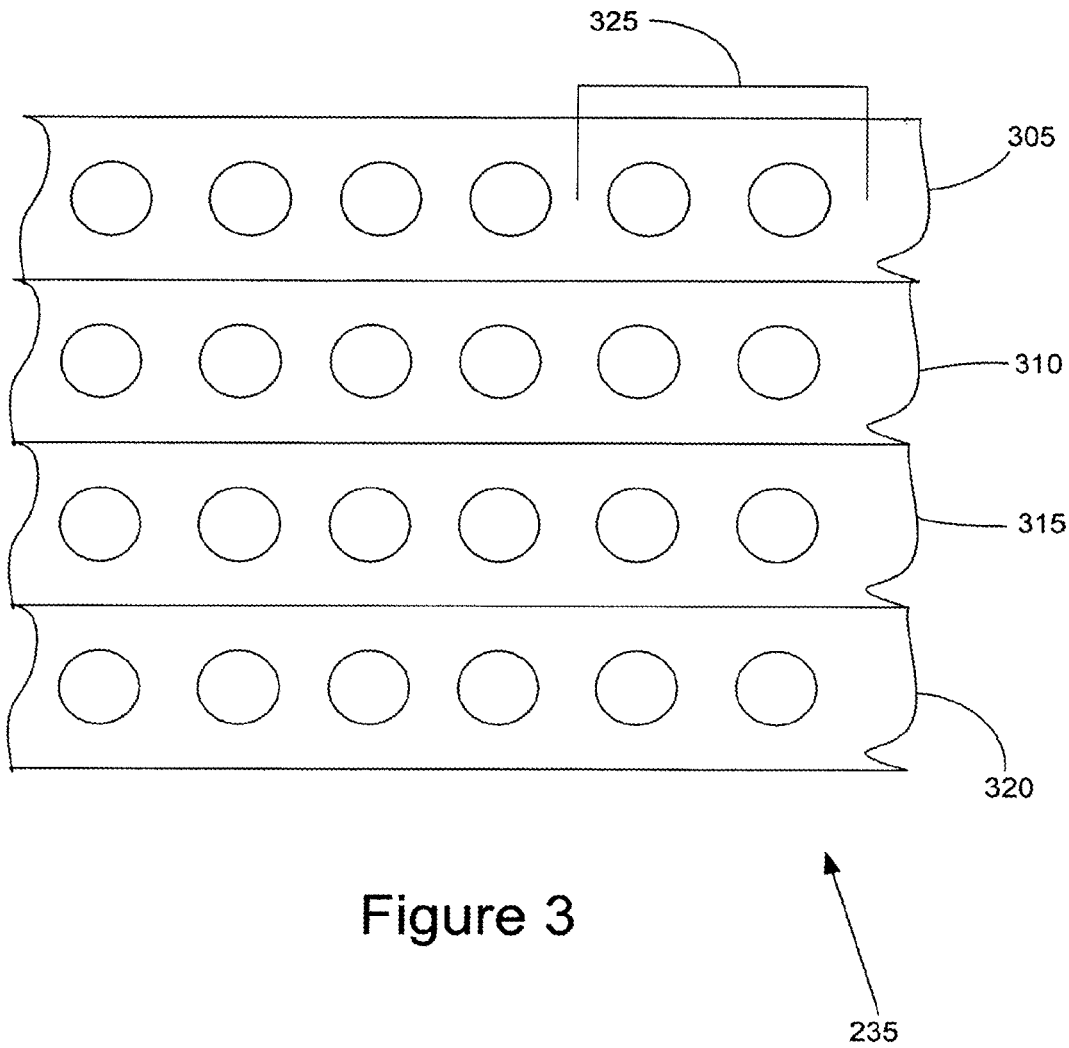
FIG. 3 is a partial plan view of the inkjet nozzles of the printer shown in FIG. 2.

FIG. 3 is a partial plan view of the inkjet nozzles 235. As shown, the inkjet nozzles 235 include a first row 305 used to eject a first color ink, a second row 310 used to eject a second color ink, a third row 315 used to eject a third color ink, and a fourth row 320 used to eject a fourth coloring. As noted, additional rows of nozzles may be added to implement a six color printing system.

The inkjet nozzles 235 of each row are logically arranged in closely spaced adjacent pairs 325. Only a single pair of the adjacent pairs is identified at 325 in FIG. 3. However, each row 305, 310, 315, and 320 includes multiple adjacent pairs of inkjet nozzles. The adjacent pairs of inkjet nozzles, such as at 325, may be spaced from one another to print using a resolution of 600 dpi, 1200 dpi, 2400 dpi, or other resolution value.

Figure 4:
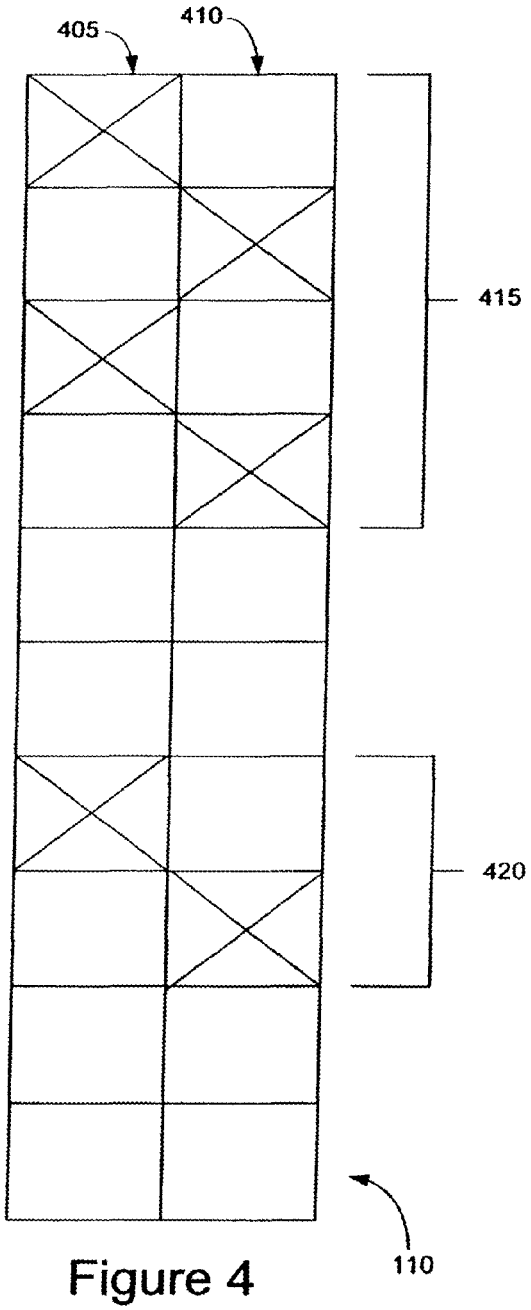
FIG. 4 shows one manner in which an adjacent pair of inkjet nozzles may be controlled to switch firing as they eject a single color along adjacent columns of a printing media.

FIG. 4 shows one manner in which the adjacent pair 325 may be controlled to switch firing as they eject a single color along adjacent columns 405 and 410 of the printing media 110. The color is printed at local areas 415 and 420 using alternate firings of the adjacent pair of inkjet nozzles 325. At local area 415, the leftmost nozzle of the adjacent pair of inkjet nozzles 325 is used to print to a first row of column 405 of the printing media 110. The second row is printed at column 410 of the printing media 110 using the rightmost nozzle of the adjacent pair of inkjet nozzles 325. The third row is printed at column 405 of the printing media 110 using the leftmost nozzle of the adjacent pair of inkjet nozzles 325. The fourth row of local area 415 is printed at column 410 of the printing media 110 using the rightmost nozzle of the adjacent pair of inkjet nozzles 325. As such, local area 415 is printed using alternate firings of the individual inkjet nozzles of the adjacent pair of inkjet nozzles 325 as the printing media 110 is driven through the printer.

The color provided by the adjacent pair of inkjet nozzles 325 is also printed to local area 420 of the printing media. At local area 420, the leftmost nozzle of the adjacent pair of inkjet nozzles 325 is used to print to a first row of column 405 of the printing media 110. The second row of local area 420 is printed at column 410 of the printing media with 110 using the rightmost nozzle of the adjacent pair of inkjet nozzles 325. As such, local area 420 is printed using alternate firings of the individual inkjet nozzles of the adjacent pair of inkjet nozzles 325 as the printing media 110 is driven through the printer.

In FIG. 4, local areas 415 and 420 are printed using alternate firings of the adjacent pair of inkjet nozzles 325 so that the inkjet nozzle used to begin printing local area 420 is different than the inkjet nozzle used to end printing of local area 415. Consecutive local areas may be printed using alternate firings of the adjacent pair of inkjet nozzles in this manner.

Figure 5:
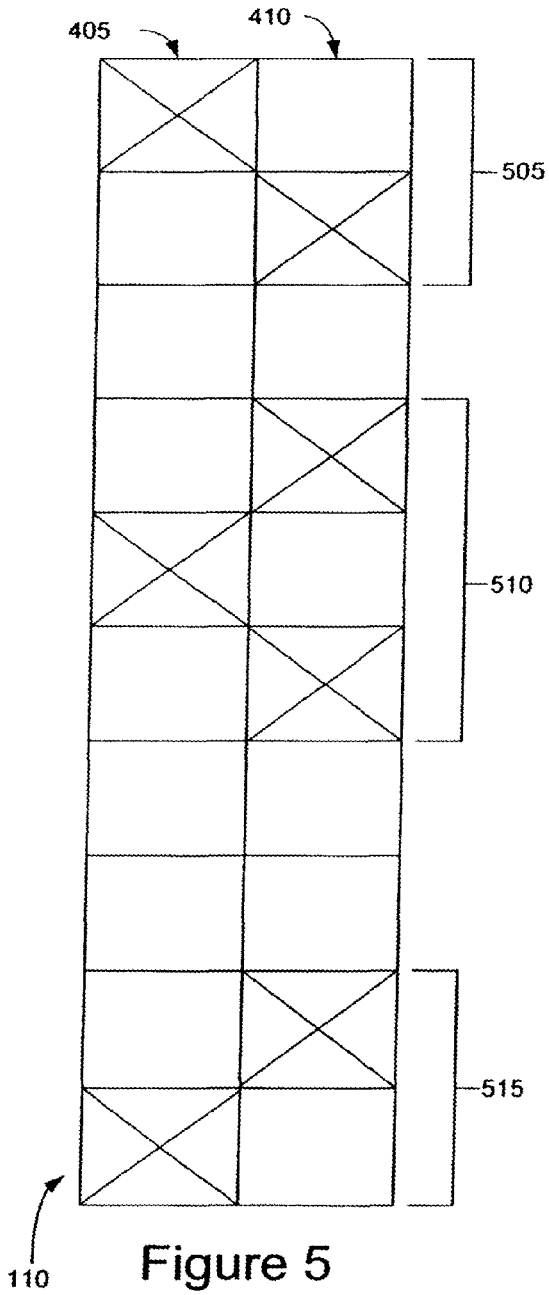
FIG. 5 shows another manner in which an adjacent pair of inkjet nozzles may be controlled to switch firing as they eject a single color along adjacent columns of the printing media.

FIG. 5 shows another manner in which the adjacent pair of inkjet nozzles 325 may be controlled to switch firing as they eject a single color along adjacent columns 405 and 410 of the printing media 110. In FIG. 5, local areas 505, 510, and 520 may be printed using alternate firings of the adjacent pair of inkjet nozzles 325 so that the inkjet nozzle used to end printing local area 505 is the same nozzle as the inkjet nozzle used to begin printing of local area 510. Similarly, the inkjet nozzle used to end printing local area 510 is the same nozzle as the inkjet nozzle used to begin printing of local area 520. In this manner, printing from the pair of inkjet nozzles 325 occurs in an alternating fashion while printing of adjacent local areas occurs in a staggered manner.

Figure 6:
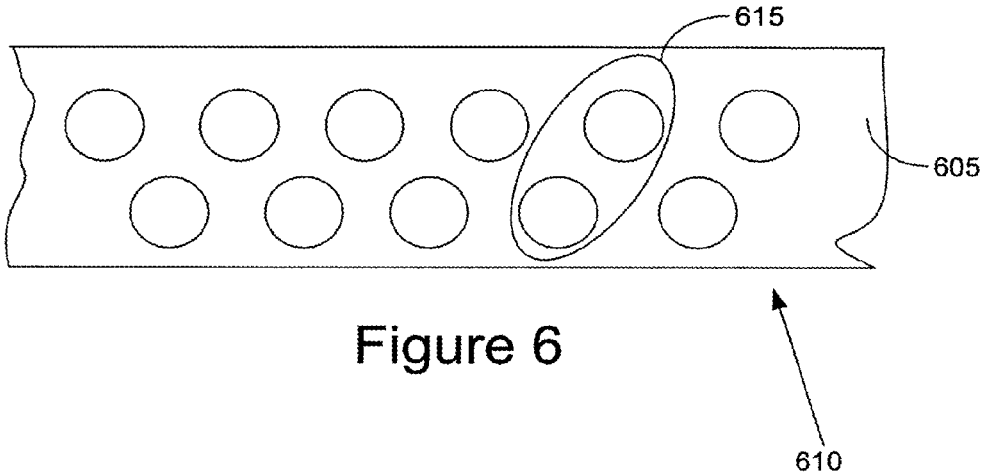
FIG. 6 shows a single row of the printhead of FIG. 4 having an alternate orientation of logically arranged adjacent pairs of inkjet nozzles.

FIG. 6 shows a single row 605 of a printhead 610 having an alternate orientation of logically arranged adjacent pairs of inkjet nozzles. In FIG. 6, the nozzles are arranged in a diagonal pattern. Pairs of inkjet nozzles 615 that are diagonally adjacent one another are logically arranged for firing in the manner shown in FIGS. 4 and 5. Row 605 is used to eject a single color. Additional rows (not shown) of printhead 610 may have the same arrangement of nozzles shown in row 605, where each additional row is used to eject another respective color.

Figure 7:
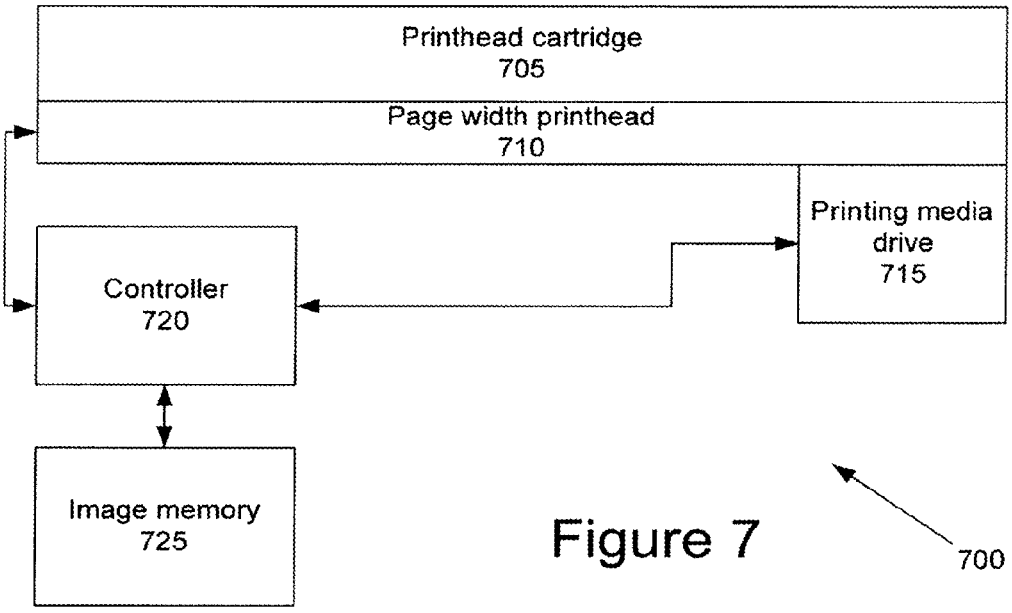
FIG. 7 is a diagram of a system that may be used to implement a page width inkjet printer having switched firings of adjacent inkjet nozzles.

FIG. 7 is a diagram of a system 700 that may be used to implement an inkjet printer having switched firings of adjacent inkjet nozzles. System 700 includes a printhead cartridge 705 having a page width printhead 710. A printing media drive 715 is used to move the printing media, such as the media shown at 110 of FIG. 1, adjacent the page width printhead 710 during printing operations. A controller 720 accesses data in image memory 725 and coordinates the firing of individual nozzles of the page width printhead 710, including the switched firing of individual nozzles of logically organized adjacent pairs of inkjet nozzles. Controller 720 may also coordinate movement of the printing media 110 with respect to the page width printhead 710 by controlling the printing media drive 715. Controller 720 may be implemented in a monolithic integrated circuit. Other circuits, such as image memory 725, may be disposed with controller 720 on the monolithic integrated circuit.

Figure 8:
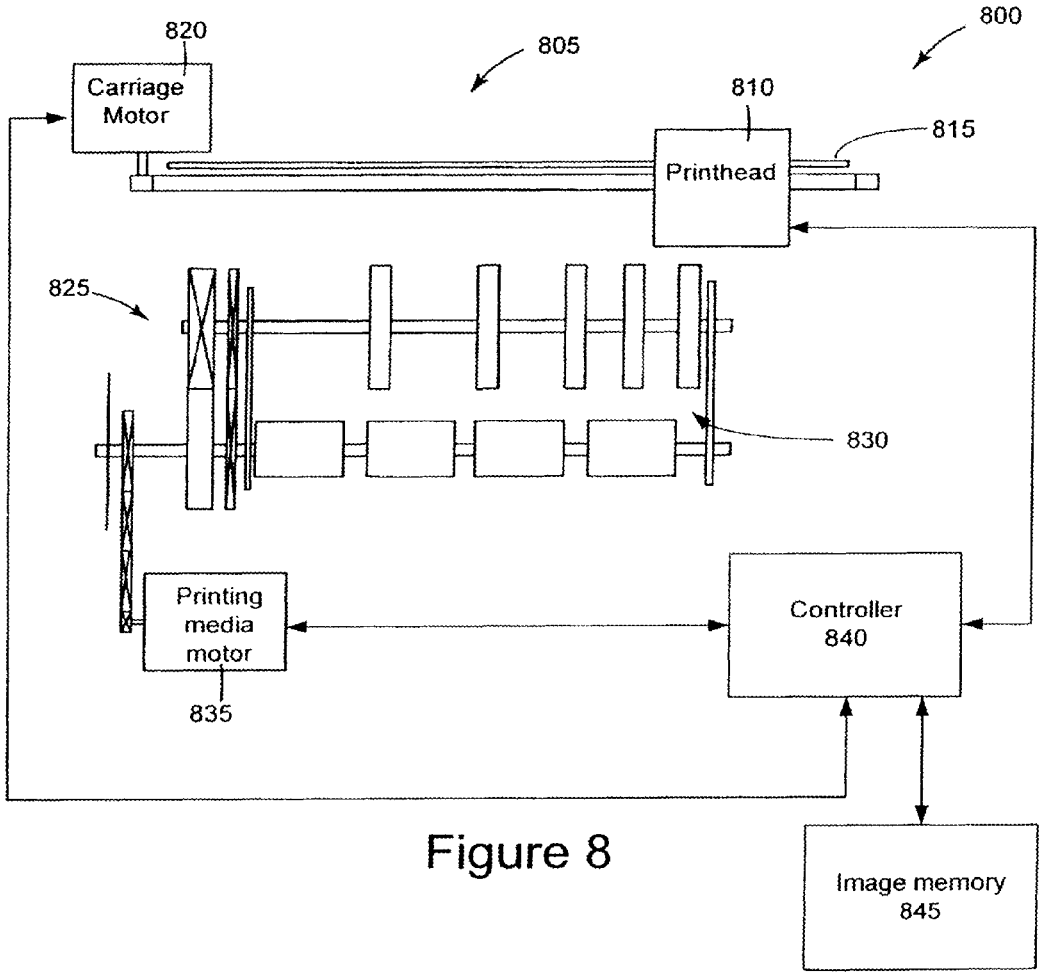
FIG. 8 is a diagram of system that may be used to implement an inkjet printer having switched firings of adjacent inkjet nozzles of a moving printhead.

FIG. 8 is a diagram of another system 800 that may be used to implement an inkjet printer having switched firings of adjacent inkjet nozzles. System 800 includes a printhead assembly 805 having a printhead 810 that is driven along a carriage support 815 by a carriage motor 820. A printing media drive 825 is used to move the printing media, such as the media shown at 110 of FIG. 1, adjacent the printhead 810 as the printhead 810 is driven back and forth along the carriage 815. The printing media drive 825 of FIG. 8 includes one or more pinch rollers 830 that are rotated by a printing media motor 835. A controller 840 accesses data in image memory 845 and coordinates the firing of individual nozzles of the printhead 810, including switched firing of individual nozzles of logically organized adjacent pairs of inkjet nozzles. Controller 840 may also coordinate movement of the printing media 110 with respect to the printhead 810 by controlling the printing media motor 835. Controller 840 may be implemented in a monolithic integrated circuit. Other circuits, such as image memory 845, may be disposed with controller 840 on the monolithic integrated circuit.

Figure 9:
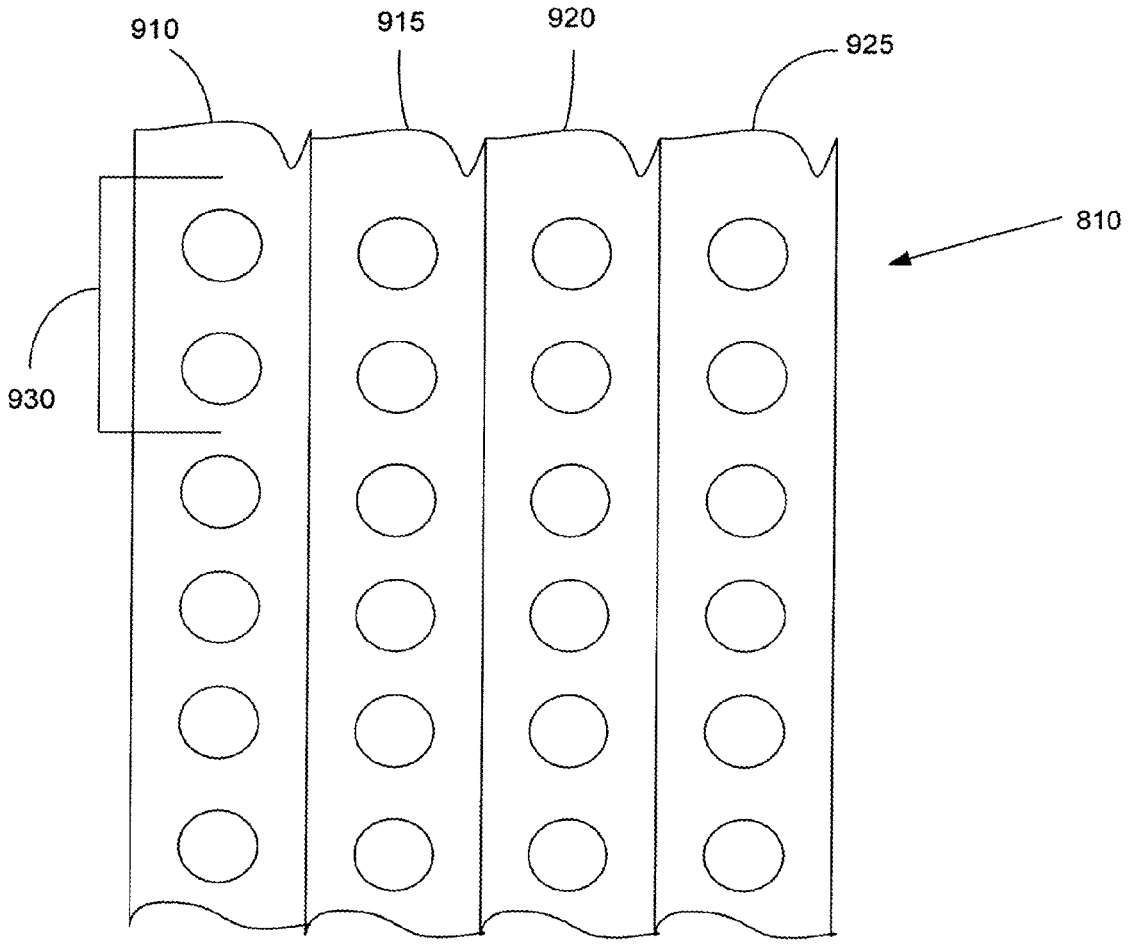
FIG. 9 is a partial plan view of a printhead that may be used in the system of FIG. 8.

FIG. 9 is a partial plan view of printhead 810. As shown, printhead 810 includes a first column of inkjet nozzles 910 for ejecting a first color ink, a second column of inkjet nozzles 915 for ejecting a second color ink, a third column of inkjet nozzles 920 for ejecting a third color ink, and a fourth column of inkjet nozzles 925 for ejecting a fourth color ink. The individual columns 910, 915, 920, and 925 may be consolidated in a single printhead cartridge or provided as individual cartridges carried by a moving support that eject a respective inkjet color. Additional nozzles and/or cartridges may be added to the printhead shown at 810 to implement a six color printing system.

The inkjet nozzles of each column are logically arranged in closely spaced adjacent pairs 930. Only a single pair of the adjacent pairs is identified at 930 in FIG. 9. However, each column 910, 915, 920, and 925 includes multiple adjacent pairs of inkjet nozzles. The adjacent pairs of inkjet nozzles, such as at 930, may be spaced from one another so as to print using a resolution of 600 dpi, 1200 dpi, 2400 dpi, or other high resolution value.

Figure 10:
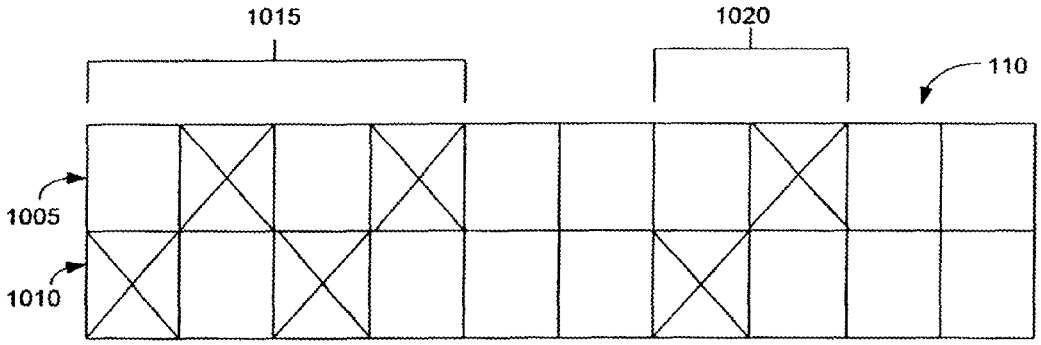
FIG. 10 shows one manner in which adjacent pairs of inkjet nozzles of a moving printhead may be controlled to switch firing as they eject a single color along adjacent rows of the printing media.

FIG. 10 shows one manner in which the adjacent pair 930 may switch firing to eject a single color from each of the inkjet nozzles of the adjacent pair 930 along adjacent rows 1005 and 1010 of the printing media 110. The color is printed at local areas 1015 and 1020 using alternate firings of the adjacent pair of inkjet nozzles 930. At local area 1015, the lowermost nozzle of the adjacent pair of inkjet nozzles 930 is used to print to a first column of row 1010 of the printing media 110. The second column is printed at row 1005 of the printing media 110 using the uppermost nozzle of the adjacent pair of inkjet nozzles 930. The third column is printed at row 1010 of the printing media 110 using the lowermost nozzle of the adjacent pair of inkjet nozzles 930. The fourth column of local area 1010 is printed at row 1005 of the printing media 110 using the uppermost nozzle of the adjacent pair of inkjet nozzles 930. As such, local area 1015 is printed using alternate firings of the individual inkjet nozzles of the adjacent pair of inkjet nozzles 930.

The color provided by the adjacent pair of inkjet nozzles 930 is also printed to local area 1020 of the printing media 110. At local area 1020, the lowermost nozzle of the adjacent pair of inkjet nozzles 930 is used to print to a first column of row 1010 of the printing media 110. The second column of local area 1020 is printed at row 1005 of the printing media with 110 using the uppermost nozzle of the adjacent pair of inkjet nozzles 930. As such, local area 1020 is printed using alternate firings of the individual inkjet nozzles of the adjacent pair of inkjet nozzles 930.

In FIG. 10, local areas 1015 and 1020 are printed using alternate firings of the adjacent pair of inkjet nozzles 930 so that the inkjet nozzle used to begin printing local area 1020 is different than the inkjet nozzle used to end printing of local area 1015. Consecutive local areas may be printed using alternate firings of the adjacent pair of inkjet nozzles in this manner.

Figure 11:
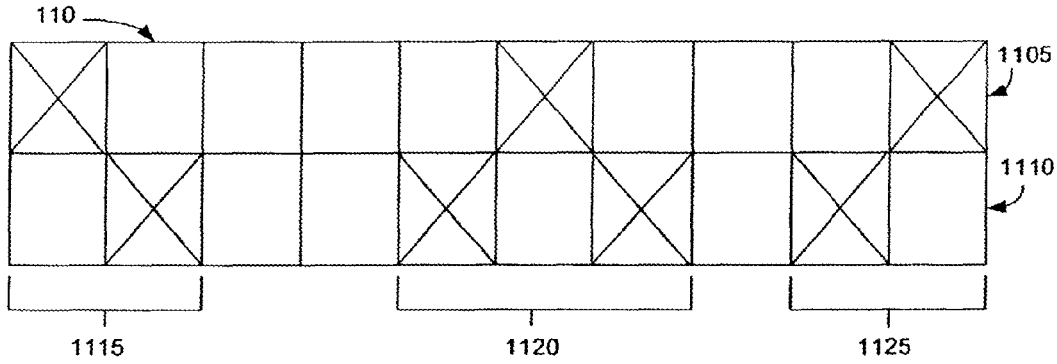
FIG. 11 shows another manner in which the adjacent pairs of inkjet nozzles of a moving printhead may be controlled to switch firing as they eject a single color along adjacent rows of the printing media.

FIG. 11 shows another manner in which the adjacent pair of inkjet nozzles 930 may be controlled to switch firing as they eject a single color along adjacent rows 1105 and 1110 of the printing media 110. In FIG. 11, local areas 1115, 1120, and 1125 may be printed using alternate firings of the adjacent pair of inkjet nozzles 930 so that the inkjet nozzle used to end printing local area 1115 is the same nozzle as the inkjet nozzle used to begin printing of local area 1120. Similarly, the inkjet nozzle used to end printing local area 1120 is the same nozzle as the inkjet nozzle used to begin printing of local area 1125. As such, adjacent local areas are printed using staggered firings of the logically organized adjacent printhead nozzles.

Figure 12:
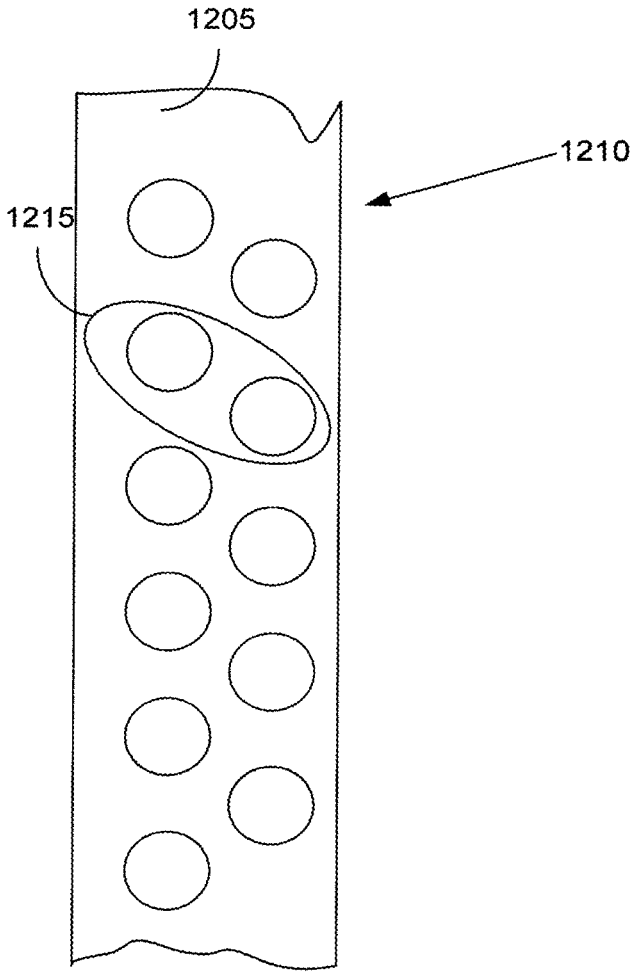
FIG. 12 shows a single column of a moving printhead having an alternate orientation of logically arranged adjacent pairs of inkjet nozzles.

FIG. 12 shows a single column 1205 of a printhead 1210 having an alternate orientation of logically arranged adjacent pairs of inkjet nozzles. In FIG. 12, the nozzles are arranged in a diagonal pattern. Pairs of inkjet nozzles 1215 that are diagonally adjacent one another may be logically arranged for firing in the manner shown in FIGS. 10 and 11. Column 1205 may be used to eject a single color. Additional columns (not shown) of the printhead 1210 may have the same arrangement of nozzles shown in column 1205, where each additional column may be used to eject another respective color.

The examples shown above logically arranged pairs of inkjet nozzles that are controlled for switched firings as they print to local areas of the printing medium. However, the inkjet nozzles may be logically arranged in other manners. For example, three or four nozzles may be logically arranged as a single configuration of nozzles and controlled for switched firings in high resolution printing.

Although the human eye is sensitive to patterns such as long streaks of missing ink caused by a malfunctioning inkjet nozzle, this effect is largely eliminated by the disclosed nozzle switching arrangements. Switched firing of the inkjet nozzles of adjacent pairs of inkjet nozzles significantly reduces patterns that would otherwise be created on the printing media by a malfunctioning nozzle. Long streaks caused by the malfunctioning nozzle are visually broken by the switched firing thereby making the printed image more pleasing to the human eye despite the malfunction.

It is intended that the foregoing detailed description be understood as an illustration of selected forms that the invention can take and not as a definition of the invention. It is only the following claims, including all equivalents, that are intended to define the scope of this invention.

What is claimed is:

1. A controller in a printing system, comprising:

an interface to a first inkjet nozzle and a second inkjet nozzle, wherein the first inkjet nozzle and the second inkjet nozzle are included in an array of nozzles forming a printhead, and are aligned in a column direction, that comprise a nozzle pair, wherein the nozzle pair is arranged such that the second inkjet nozzle is the closest inkjet nozzle to the first inkjet nozzle in the column direction and the first inkjet nozzle and the second inkjet nozzle are configured to dispense a common colored ink; and wherein the controller is configured to:

access image data; and control alternate activation of the first inkjet nozzle and the second inkjet nozzle with respect to a local region such that both the first inkjet nozzle and the second inkjet nozzle are activated to print the image data within the local region during a printing process, wherein the image data is such that the first inkjet nozzle and the second inkjet nozzle are arranged in a logical pair for the local region of an image, wherein the length of the local region in the column direction is less than the length of the nozzle array that forms the printhead.

2. The controller of claim 1, where the printhead comprises multiple sets of adjacent inkjet nozzles dispensing different colored inks, and where each set of adjacent inkjet nozzles dispenses a common colored ink.

3. The controller of claim 1, where the printhead is a sweeping printing head that is movable with respect to a printing medium.

4. The controller of claim 1, where the printhead comprises multiple configurations of adjacent inkjet nozzles dispensing different colored inks, and where each configuration of adjacent inkjet nozzles dispenses a common colored ink.

5. The controller of claim 1, where each configuration of adjacent inkjet nozzles comprises a pair of adjacent inkjet nozzles.

6. The controller of claim 1, wherein the controller is configured to control advancement of a printing medium during the printing process and control the alternate activation of the first inkjet nozzle and the second inkjet nozzle during the printing process.

7. The controller of claim 1, wherein the controller is configured to control the alternate activation of the first inkjet nozzle and the second inkjet nozzle in increments of columns of the image data.

8. The controller of claim 1, wherein the controller is configured to access the image data by receiving the image data.

9. The controller of claim 1, wherein the controller is implemented in a monolithic integrated circuit.

10. The controller of claim 9, wherein the controller is disposed on the monolithic integrated circuit with image memory.

11. A method for operating a controller for a printing system, comprising:

accessing image data;

selecting, as part of the printing process, from an array of nozzles forming a printhead, a first inkjet nozzle and a second inkjet nozzle that are aligned in a column direction, to form a nozzle pair of inkjet nozzles for printing at least a portion of the image data, wherein the nozzle pair is arranged such that the second inkjet nozzle is the closest inkjet nozzle to the first inkjet nozzle in the column direction;

arranging the image data such that the first inkjet nozzle and the second inkjet nozzle form a logical pair for a local region of an image, wherein the length of the local region in the column direction is less than the length of the nozzle array that forms the printhead;

controlling activation, as part of a printing process for the local region, the first inkjet nozzle to print a portion of the image data on a printing medium while the second inkjet nozzle is in a non-activated state; and controlling alternate activation of the first inkjet nozzle and the second inkjet nozzle with respect to the local region such that both the first inkjet nozzle and the second inkjet nozzle are activated to print the image data within the local region during the printing process.

12. The method of claim 11, further comprising controlling logical arrangement of adjacent inkjet nozzles in pairs for activation.

13. The method of claim 11, further comprising controlling the activation of multiple configurations of adjacent inkjet nozzles to dispense multiple colored inks, where each configuration of adjacent inkjet nozzles dispenses a common color.

14. The method of claim 11, further comprising controlling the activation of multiple pairs of adjacent inkjet nozzles to dispense multiple colored inks, where each pair of adjacent inkjet nozzles dispenses a common colored ink.

15. The method of claim 11, wherein controlling the alternate activation of the first inkjet nozzle and the second inkjet nozzle during the printing process is implemented in increments of columns of the image data.

16. The method of claim 11, further comprising controlling logical arrangement of adjacent inkjet nozzles into multiple configurations of adjacent inkjet nozzles, where each configuration of adjacent inkjet nozzles dispenses a common colored ink.

17. The method of claim 11, further comprising controlling advancement of a printing medium during the printing process.

18. The method of claim 11, wherein accessing the image data comprises receiving the image data.

19. The method of claim 11, wherein accessing the image data comprises assessing the image data in image memory.

20. The method of claim 11, further comprising coordinating firing of individual nozzles of the printhead.

* * * * *